US005667355A

United States Patent [19]

Gamperling

[11] Patent Number: 5,667,355

[45] Date of Patent: Sep. 16, 1997

[54] DEVICE FOR DECOLLATING CARDS FROM A STACK OF CARDS

[75] Inventor: Rudolf Gamperling, Augsburg, Germany

[73] Assignee: Böwe Systec AG, Augsburg, Germany

[21] Appl. No.: 596,268

[22] PCT Filed: Aug. 9, 1994

[86] PCT No.: PCT/EP94/02641

§ 371 Date: Feb. 7, 1996

§ 102(e) Date: Feb. 7, 1996

[87] PCT Pub. No.: WO95/05331

PCT Pub. Date: Feb. 23, 1995

[30] Foreign Application Priority Data

Aug. 12, 1993 [DE] Germany ..... 9312049 U

[51] Int. Cl.[6] ..... B65G 59/06

[52] U.S. Cl. ..... 414/797.7; 221/236; 271/10.09; 414/795.8

[58] Field of Search ..... 221/236; 271/10.09, 271/109, 131; 414/795.8, 797.7, 797.9

[56] References Cited

U.S. PATENT DOCUMENTS 2,417,938 3/1947 Krueger ..... 221/211

5,082,268 1/1992 Santoro ..... 414/797.9 X 5,395,208 3/1995 Mojden et al. ..... 414/795.8

FOREIGN PATENT DOCUMENTS 1367829 6/1964 France ..... 414/797.7

52-66273 6/1977 Japan ..... 271/131

*Primary Examiner*—Karen B. Merritt

*Assistant Examiner*—Janice L. Krizek

*Attorney, Agent, or Firm*—McGlew and Tuttle

[57] ABSTRACT

The present invention pertains to the problem of decollating the lowest card 3 of a stack 2 of cards guided in a shaft 1 without giving rise to a considerable friction between the card surfaces. This problem, which arises especially in the case of plastic cards designed as printed data storage media, is solved by the present invention by the lowermost card 3 being located with its front 4 and rear 5 edges between two push-off members 6, 7, which are mounted rotatably around two mutually parallel axes 12, 13. The lowermost card 3 is first pushed off to the rear 8 by a small amount, and it is at the same time spaced from the card located above it, after which the front edge 4 of the card is released and is freely movable in the downward direction. The lowermost card 3 is then pushed off in the opposite direction 9, and it reaches a conveyer in an oblique free fall.

10 Claims, 3 Drawing Sheets

*Fig. 4*
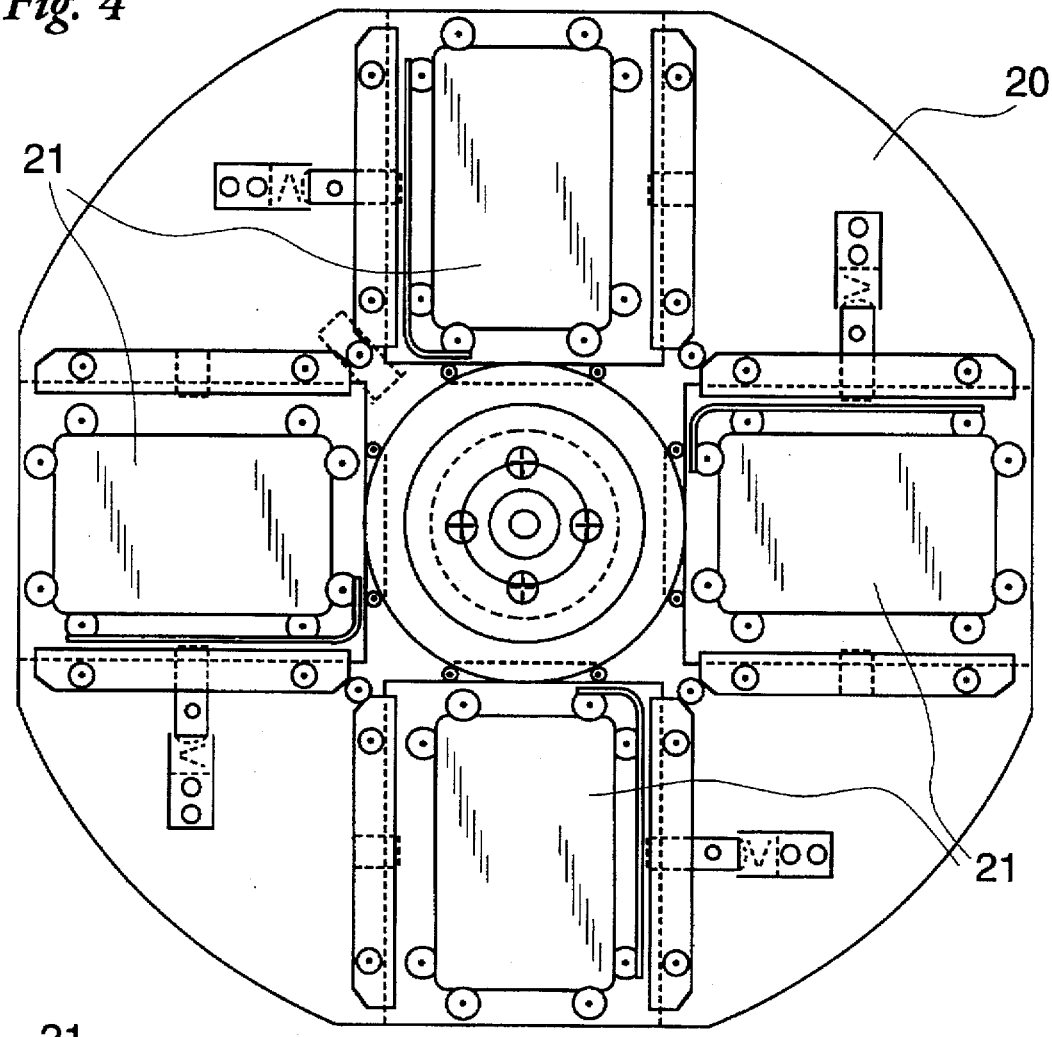
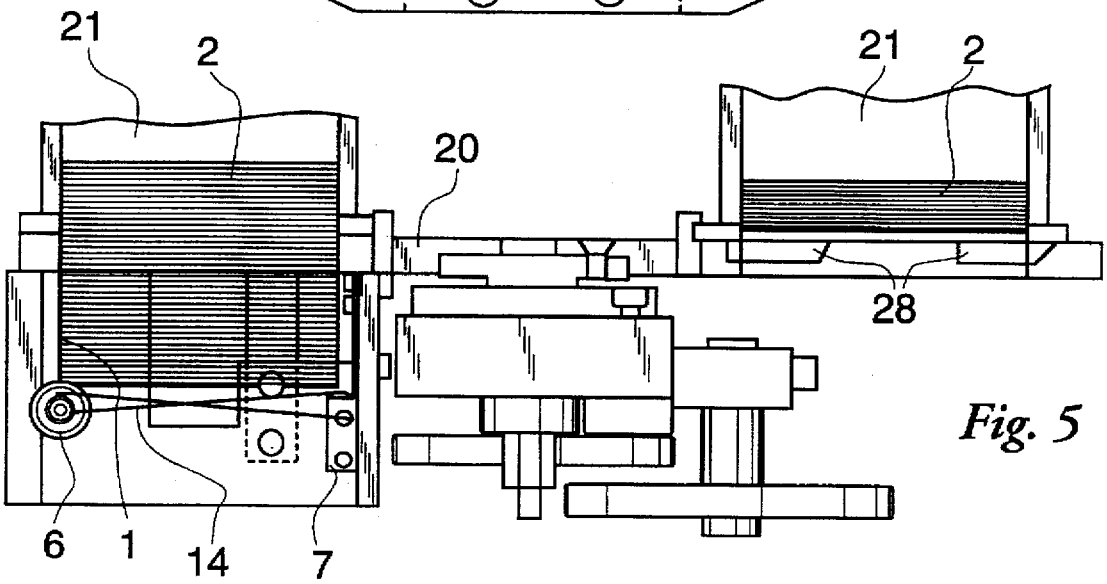
*Fig. 5*

DEVICE FOR DECOLLATING CARDS FROM A STACK OF CARDS

FIELD OF THE INVENTION

The present invention pertains to a device for removing the lowermost plate or card of a stack of plates or cards guided in a shaft, e.g., a plastic card used as a data storage medium.

BACKGROUND OF THE INVENTION

It has been known to provide an arrangement wherein the lowermost card of a stack of cards is pulled off by means of a conveyor belt, against which the lowermost card is pressed by the weight of the stack of cards. This measure has the disadvantage that the whole-area of contact is subject to frictional forces, namely the contact area along the card to be pulled off and the next card. If the cards are printed or are provided with other colored layers, there is a risk of a rubbing off of the color coating and therefore a risk of a smudging of the print. This problem occurs especially during the handling of plastic cards, which are designed as data storage media.

A device for removing the lowermost plate from a stack of plates guided in the shaft is known from DE-A-34 42 123.

The front edge of the lowermost plate lies on a flat support surface in the circumference of a first push-off member. The rear edge of the lowermost plate rests on a rotatably mounted roller, in the area of which two additional push-off members are provided, one of which can be moved to and from as a pusher in the plane of the lowermost plate and the other is designed as a rocker.

To remove the lowermost plate, this plate is first displaced by a small mount to the rear by the first push-off member, while the pusher evades this movement, and the rocker is located in a rearwardly directed starting position. During a further rotary movement of the first push-off member, the front edge of the plate comes free from this push-off member, and the pusher moves the rear edge of the plate into its original position. The rear edge of the plate now rolls on the stationary roller, and the plate assumes an oblique position. The front edge of the plate is supported in this oblique position on an oblique sliding surface, while only the second push-off member, designed as a rocker, acts on the rear edge of the plate and pushes off the plate along the sliding surface in the direction of a conveyor located under it. Consequently, two rear push-off members, which require a separate drive each and whose movements must be coordinated with one another, are necessary for pushing off the lowermost plate in this prior-art device.

SUMMARY AND OBJECTS OF THE INVENTION

The primary object of the present invention is to develop a decollating device, which makes it possible to pull a card out of a stack without large-area frictional contact and which prevents the cards from being bent or deformed during the decollation.

A further object of the invention is to simplify the prior art device and to design it for removing cards, especially plastic cards used as data storage media.

According to the invention, a device is provided for removing the lower most card of a stack of cards, the cards being guided in a shaft. The cards are for example plastic cards used as data storage medium, including for example credit cards, debit cards, security cards, phone cards and other similar data/information storage cards or plates of a similar nature. Two push-off members acting on opposite plate edges are arranged in a plane of the lower most plate. The first push-off member is mounted under a front plate edge and is designed as a rotatably driven body of revolution. The first push-off member has a flat support surface in its circumference for the front edge of the lower most plate (card) and the first push-off member generates a short lateral movement of the lowermost plate in its plane opposite the actual push-off direction. The second push-off member is designed as a rocker which evades the rear plate edge associated with it during the first push-off process and is moved in the opposite direction against the rear plate edge during the second push-off process. The device is provided for moving the cards in which the card is released by the first push-off member or a free-fall onto the conveyor belt and that a narrow strip-shape support for the associated rear edge of the lower most card is provided in the area of the second push-off member and, adjoining it, a gap with a width adapted to the thickness of the card is provided in a plane of the card. The clamping member holds the rear card edge when the lowermost card is pushed-off to the rear and is located in the area of the plane of the card.

The present invention provides two push-off members acting on opposite edges of the card and arranged in the plane of the lowermost card, wherein the first push-off member generates a short lateral movement of the lowermost card in its plane in one direction, and the second push-off member generates a push-off movement of the card in the opposite direction, so that the card is released by the first push-off member for the free fall onto a conveyor.

Friction occurs with this method only during the first, short push-off movement of the card, and the lowermost card is also spaced from the next card at the same time until the front edge of the card has been released by the first push-off member. From this point in time on, there is only a slight friction in the area of the rear edge of the card, namely, while the second push-off member strikes this rear edge of the card and pushes off the card, whose other areas are already free, in the direction of the conveyor located under it.

The first push-off member is a rotatably driven body of revolution, which has a flat support surface in its circumference for the front edge of the lowermost card. As a consequence, this push-off member is located under the front edge of the stack. The radial extension of this flat support surface approximately corresponds to the thickness of one card. The radial extension is limited by a step, which in turn acts as a push-off element and with which the front edge of the card comes into contact. A ¼ rotation of the first push-off member is sufficient to release the front edge of the card for the subsequent free fall. During this ¼ rotation, the lowermost card is detached from the next card during the short rearward movement, so that the friction is limited to a minimum.

The second push-off member is designed as a rocker such that it evades the rear edge of the card during the first rearward push-off movement until the front end of the card has become released in order to subsequently come into contact with the rear edge of the card during an opposite rotary movement and to finally push off the lowermost card.

The two push-off members are rotatable around axes that are parallel to one another and together they form a crank mechanism.

The rear edge of the card is slightly clamped during the first short push-off movement, so that the card cannot fall off by itself upon being released by the front push-off member.

The rear area of the edge of the card needs only to be pushed into a fitting gap of the shaft wall, into which one or more balls also extend elastically. These balls are pressed down by the edge of the card against the spring action. The spring action is sufficient for achieving the desired clamping of the card until the second push-off member can come into contact with the rear edge of the card.

The shaft with stacks of cards is preferably gently loaded, where a high output is also to be reached. However, it should be pointed out that the loading of a shaft for decollating cards does not necessarily require that the decollating device be designed with all the particulars as noted above. The arrangement of a rotary table with loading shafts described may also be used with success in other decollating devices.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a top view of a rotary table with a plurality of loading shafts;

FIG. 5 is a front view of the arrangement according to FIG. 4;

DESCRIPTION OF THE PREFERRED EMBODIMENT

Figure 1:
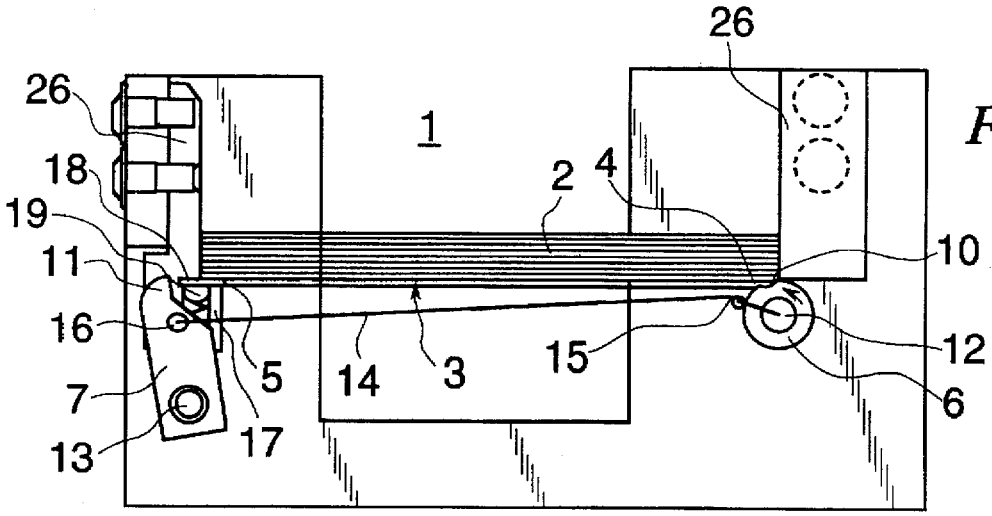
FIG. 1 is a cross sectional view through a shaft for receiving a stack of cards.

Referring to the drawings, FIG. 1 shows the exemplary embodiment with a shaft 1. Between the shaft walls 26 a stack of cards 2 is located, from which the lowermost card 3 is to be pulled off and decollated.

The stack of cards 2 lies on a flat support surface 10 of a first push-off member 6 at the front edge 4 of the card, and on a strip-like support 17 at the rear edge 5 of the card.

A gap 18 is provided having a width dimensioned to be such that the lowermost card 3 can be pushed into the gap 18. The gap 18 extends in the same plane as the lowermost card 3 in the area of the rear edge 5 of the card. At least one, but preferably two elastically supported balls 19 extend into the gap 18. The spring force is adjusted to be such that the balls are pushed away when the lowermost card 3 is pushed into the gap 18, but the spring force is so strong that the rear edge area 5 of the card is clamped by the balls 19 after it has been pushed into the gap 18.

The first push-off member 6 is driven rotatably around the axis 12 in the direction of the arrow 30. As a result, the stepped end of the flat support surface 10 comes into contact with the front edge 4 of the card and causes the lower card 3 to be displaced in the direction of the arrow 8 (cf. FIG. 2), while the rear end 5 of the card penetrates into the gap 18.

The second push-off member 7, which is designed as a rocker and can be rotated alternatingly around the axis 13, is actuated by the first push-off member 6 via a connecting rod 14. The two axes 12, 13 are aligned in parallel to one another. The connecting rod 14 is connected via hinges 15, 16 to both push-off members 6, 7. A four-bar chain or crank mechanism, in which the first push-off member 6 acts as the driving element in the sense of a crank, is formed as a result.

It is, of course, also possible to impart an oscillating rotary movement around the axis 12, e.g. by an angle of ±180°, to the first push-off member 6.

Figure 2:
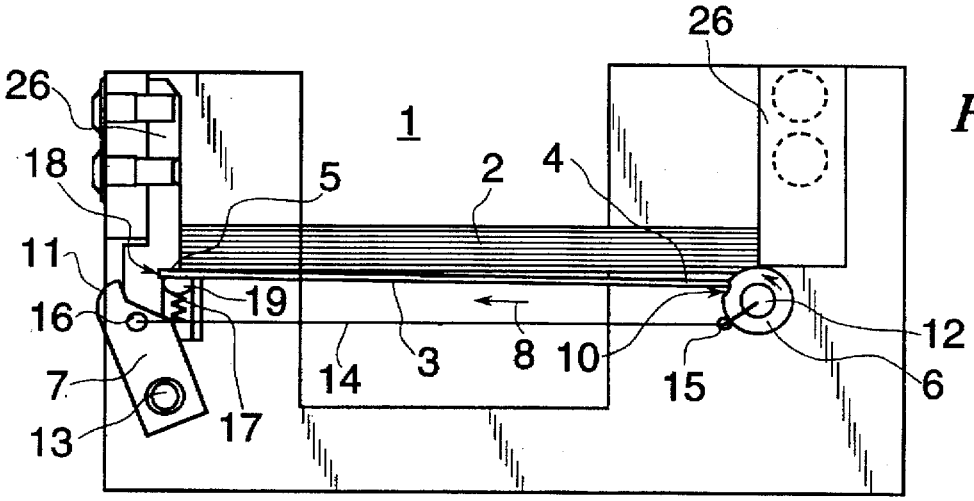
FIG. 2 is a sectional view through the shaft according to FIG. 1 with a lower card slightly displaced to the rear.

The linking of the connecting rod 14 is set to be such that its push-off tip 11 evades the rear edge 5 of the card, while the lower card 3 is brought into the position according to FIG. 2 by the first push-off member 6. The card 3 is almost completely separated from the next card of the stack 2 of cards, and only the rear edge 5 of the card is clamped in the gap 18 by the balls 19. When the first push-off member 6 has performed a ¼ movement, the front edge 4 of the card can separate from the support surface 10 of the first push-off member 6 and move downward.

No bending or other deformation of the card takes place during the first movement section. The lower card 3 also separates practically immediately from the next card, so that the card surface is hardly subject to any friction.

Figure 3:
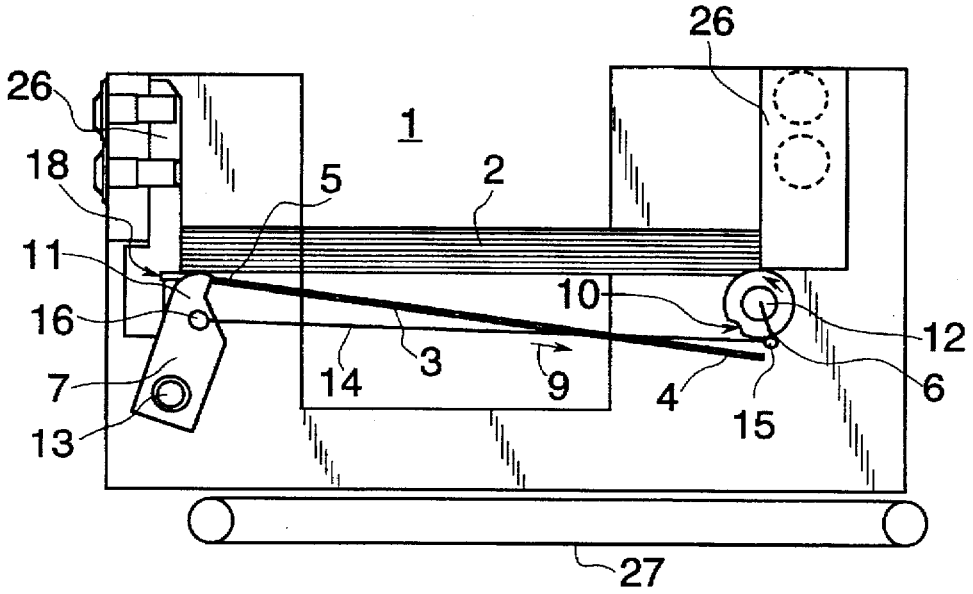
FIG. 3 is a cross sectional view through the shaft according to FIG. 1 with a lower card in the push-off position.

When the first push-off member 6 moves from the position according to FIG. 2 into that according to FIG. 3, the movement of the connecting rod 14 reverses into the direction of the arrow 9. The push-off tip 11 of the second push-off member 7 now strikes the rear edge 5 of the card and it pushes this edge out of the gap 18. The lower card 3 can fall off freely in this position shown in FIG. 3, and it acquires a movement impulse in the direction of the arrow 9 due to the rotary movement of the push-off tip 11. The card 3 can now fall onto a conveyer, 27, under the stack 2 of cards in a controlled manner, and the conveyor 27 brings the card to a subsequent work station.

The arrangement described here is suitable especially for decollating plastic cards, which are used as data storage media. The embossings and imprints usually present in such data storage media are extensively spared by the pulling off of the cards according to the present invention, because surface frictions and deformations are avoided. However, the decollating device according to the present invention may also be used for any other cards and they have sufficient rigidity for the push-off movement to be able to be performed by the first push-off member 6.

Figure 6:
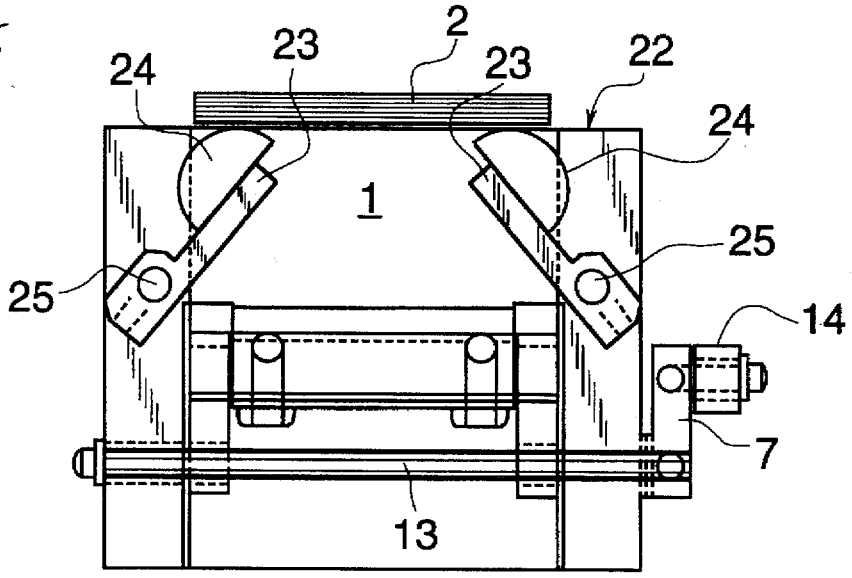
FIG. 6 is a sectional view through a shaft according to FIG. 1 in another section plane with supports for lowering a stack of cards to be loaded in a position.
Figure 7:
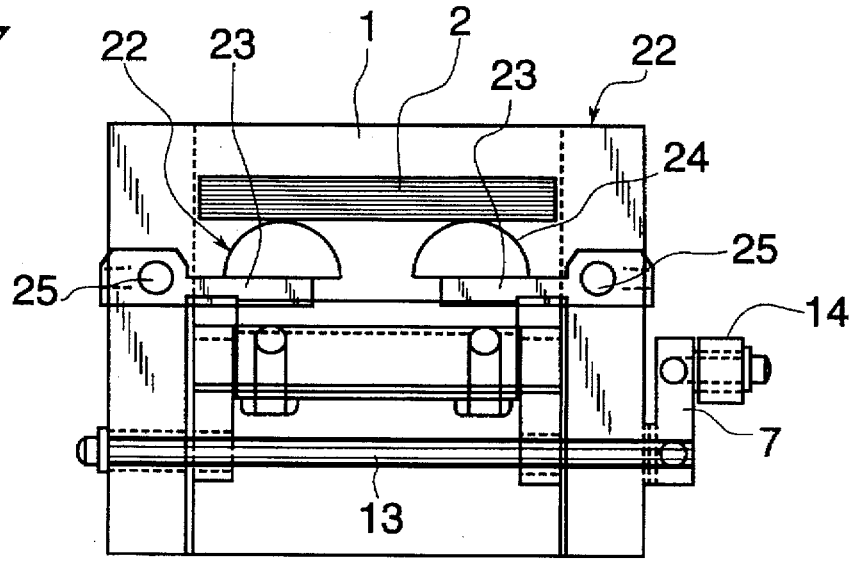
FIG. 7 is a view similar to FIG. 6 but showing a different position.
Figure 8:
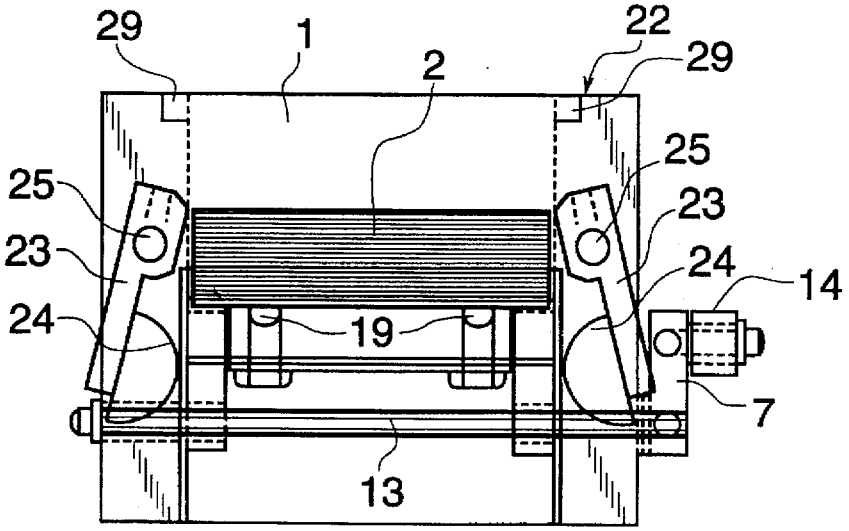
FIG. 8 is a view similar to FIG. 6 but showing still another different position.

The output of the decollating device according to the present invention is extremely high, and a device, which makes possible the rapid reloading of the shaft with stacks 2 of cards, is therefore shown in FIGS. 4 and 5. According to these figures, a plurality of loading shafts 21, which can be manually loaded with stacks 2 of cards from the top, are arranged on a rotary table 20. The shaft 1 according to FIGS. 1 through 3 is located under one of the loading shafts 21 in the resting position of the rotary table 20. The stack of cards shall then be able to be lowered into the shaft 1 located under it during the stoppage of the rotary table 20, without individual cards being able to become separated and to assume an oblique position. An arrangement comprising two supports 23, which is flush with the top edge 22 of the shaft and receives the arriving stack 2 of cards, is provided for this purpose in the shaft 1 according to the present invention, corresponding to FIGS. 6 through 8. The supports 23 are rotatable around the axes 25 in mutually opposite directions. They have cylindrical support surfaces 24, which roll on the lower card when the supports 23 are lowered and therefore also act gently on the cards 2. The stack 2 of cards has reached its lower support position according to FIG. 1 in the position according to FIG. 8. The supports 23 with their support surfaces 24 are guided to the outside by corresponding recesses in the shaft walls 26, so that they cannot interfere with the decollation of the cards.

This first described loading process of the shaft 1 presumes that there are no cards 3 in the shaft 1. The supports 23 remain in the inactive position according to FIG. 8 during the reloading of a shaft 1 still containing cards 3.

Retaining fingers 28, which close the loading shafts 21 of the rotary table 20 at the bottom, are used, instead. A photoelectric cell 29, is located within the shaft 1, practically a few mm below the top edge 22 of the shaft. The passage of the actually topmost card 3 of a stack 2 of cards past this photoelectric cell is indicated by the cell, as a result of which a rotary movement of the rotary table 20 is started, which brings a next stack 2 of cards congruently over the shaft 1. The retaining fingers 28 are now retracted, after which the stack 2 of cards can fall onto the cards 3 located in the shaft 1.

While specific embodiments of the invention have been shown and described in detail to illustrate the application of the principles of the invention, it will be understood that the invention may be embodied otherwise without departing from such principles.

LIST OF REFERENCE NUMBERS

1 Shaft
2 Stack of cards
3 Lowermost card
4 Front edge of card
5 Rear edge of card
6 First push-off member (crank)
7 Second push-off member (rocker)
8 Direction of movement
9 Direction of movement
10 Flat support surface
11 Push-off tip
12 Axis
13 Axis
14 Connecting rod
15 Hinge
16 Hinge
17 Strip-like support
18 Gap
19 Ball
20 Rotary table
21 Loading shaft
22 Top edge of shaft
23 Support
24 Support surface
25 Axis
26 Shaft wall

We claim:

1. A device for removing the lowermost card of a stack of cards guided in a shaft, the device comprising:

a first push-off member mounted on a first wall of the shaft and including a rotatably driven body of revolution including a flat support surface at a peripheral location of said rotatably driven body, said flat support surface for engaging a first edge of the lowermost card in the shaft and for generating in a first push off process a short lateral movement of the lowermost card in a plane of the lowermost card in the shaft, in a direction opposite to an actual push-off direction; and a second push-off member including a rocker which evades a second edge of said lowermost card during said first push-off process, said second push-off member being moved during a second push-off process against said second card edge in said actual push-off direction, said first push-off member and said second push-off member being arranged in said plane of said lowermost card in the shaft, said lowermost card being released by said first push-off member for free-fall during said second push-off process;

a strip-shape support for supporting said second edge of said lowermost card, said strip-shape support being disposed adjacent to said second push-off member, a gap being formed adjacent to said strip-shape support defining a width adapted to a thickness of the card, the gap being provided in said plane of the lowermost card in the shaft;

a clamping member for holding said second card edge when said lowermost card is pushed in said direction opposite to said actual push-off direction; and a conveyor belt disposed under said stack for receiving said card.

2. A device according to claim 1, wherein said first push-off member and said second push-off member are mounted rotatably around mutually parallel axes and are connected to one another by a connecting rod in an articulated manner.

3. A device according to claim 1, wherein said first push-off member is designed as a rotatably driven crank.

4. A device according to claim 1, wherein said clamping member includes a spring-supported ball acting as a non-positive clamping member for clamping said second edge of said lowermost card after said lowermost card has been moved laterally in said direction opposite to said actual push-off direction.

5. A device according to claim 1, further comprising a rotary table including a plurality of loading shafts for holding stacks of cards, said rotary table being arranged to be rotatable in a stepwise manner above said shaft, one of said loading shafts being aligned with said shaft in a resting position of said rotary table.

6. A device according to claim 5, further comprising rotatably mounted supports movable between a position flush with a top edge of said shaft for guiding cards therein and being lowerable into a position below a support plane of the lowermost card in said shaft, said rotatably mounted supports for supporting said stack of cards located in one of said loading shafts of said rotary table.

7. A device according to claim 6, wherein: said supports have a support surface which is one of spherically or cylindrically arched.

8. A device according to claim 5, further comprising a signal transmitter which initiates a rotary movement of said rotary table during the passage of a topmost card of a stack of cards in said shaft and brings a next stack of cards congruently over said shaft, said signal transmitter being located in said shaft, said loading shafts of said rotary table being closed on an underside by retaining fingers driven in an evading manner.

9. A device according to claim 8, wherein said signal transmitter is a photoelectric cell.

10. A device for removing a lowermost card of a stack of cards, the device comprising:

a shaft holding the stack of cards, the lowermost card of the stack held in said shaft occupying a plane;

a first push-off member mounted on a first side of said shaft, said first push-off member including a rotatably driven body of revolution with a flat support surface at a peripheral location of said rotatably driven body, said flat support surface engaging a first edge of the lowermost card in said shaft and generating in a first push off process a short lateral movement of the lowermost card in said plane of the lowermost card in said shaft, in a direction opposite to an actual push-off direction;

a second push-off member mounted on a second side of said shaft, said second push-off member including a rocker which evades a second edge of the lowermost card during said first push-off process, said second push-off member being moved during a second push-off process against said second card edge in said actual push-off direction, said first push-off member and said second push-off member being arranged in said plane of said lowermost card in said shaft, said lowermost card being released by said first push-off member for free-fall during said second push-off process;

a strip-shape support for supporting said second edge of the lowermost card, said strip-shape support being disposed adjacent to said second push-off member, a gap being formed adjacent to said strip-shape support defining a width adapted to a thickness of the card, said gap being provided in said plane of the lowermost card in said shaft;

a clamping member for holding said second card edge when said lowermost card is pushed in said actual push-off direction.

* * * * *